US005986631A

United States Patent [19]

Nanno et al.

[11] Patent Number: 5,986,631

[45] Date of Patent: Nov. 16, 1999

[54] METHOD FOR DRIVING ACTIVE MATRIX LCD USING ONLY THREE VOLTAGE LEVELS

[75] Inventors: Yutaka Nanno, Takarazuka; Yoneharu Takubo, Toyonaka, both of Japan

[73] Assignee: Matsushita Electric Industrial Co., Ltd., Osaka, Japan

[21] Appl. No.: 08/671,346

[22] Filed: Jun. 27, 1996

[30] Foreign Application Priority Data

Jul. 5, 1995 [JP] Japan ..... 7-169970

[51] Int. Cl.[6] ..... G09G 3/36

[52] U.S. Cl. ..... 345/94; 345/92

[58] Field of Search ..... 345/58, 92, 94, 345/95, 208, 210

[56] References Cited

U.S. PATENT DOCUMENTS

| | | | |
|---|---|---|---|
| 4,955,697 | 9/1990 | Tsukada et al. | 345/92 |
| 5,151,805 | 9/1992 | Takeda et al. | 345/94 |
| 5,296,847 | 3/1994 | Takeda et al. | 345/92 |
| 5,369,512 | 11/1994 | Yanai et al. | 345/92 |
| 5,398,043 | 3/1995 | Takeda et al. | 345/94 |
| 5,657,039 | 8/1997 | Mizukata et al. | 345/95 |
| 5,657,041 | 8/1997 | Choi | 345/94 |
| 5,666,133 | 9/1997 | Matsuo et al. | 345/90 |
| 5,686,932 | 11/1997 | Tomita | 345/94 |
| 5,706,023 | 1/1998 | Nagata et al. | 345/92 |

FOREIGN PATENT DOCUMENTS 2-157815 6/1990 Japan .

OTHER PUBLICATIONS

Nanno et al., Characterization of the Sticking Effect of TFT–LCDs, Proceedings of the SID, vol. 31/4, 1990.

Takeda et al., A Capacitively Coupled TFT–LCD Driving Method, Proceedings of the SID, vol. 31/2, 1990.

*Primary Examiner*—Jeffery Brier
*Assistant Examiner*—Paul A. Bell
*Attorney, Agent, or Firm*—Morrison & Foerster LLP

[57] ABSTRACT

A driving method of an active matrix LCD is provided. According to this method, a scan signal has three voltage levels, i.e., an ON voltage Vg, an OFF voltage Voff and a compensation voltage Ve having the opposite polarity with respect to the OFF voltage Voff. In contrast with the conventional capacitively coupled driving method in which the scan signal consists of four voltages, the driving method of this invention can reduce a cost and power consumption for a driver IC without degradation due to flickers or other causes. The method for adjusting the brightness of the LCD accompanying this driving method as well as the method for optimizing design parameters of the compensation voltage Ve and a thin film transistor of the LCD are also described.

5 Claims, 11 Drawing Sheets

PRIOR ART

PRIOR ART

PRIOR ART

PRIOR ART

PRIOR ART

METHOD FOR DRIVING ACTIVE MATRIX LCD USING ONLY THREE VOLTAGE LEVELS

BACKGROUND OF THE INVENTION

This invention relates to a method for driving an active matrix LCD (Liquid Crystal Display) and a structure of the LCD suited for the method.

An active matrix LCD using TFT (Thin Film Transistors) can obtain a better quality image than a simple matrix LCD. FIG. 7 shows a schematic view of an LCD panel of an active matrix LCD system. This LCD panel comprises a scan line (i.e., gate bus) 1, TFT 2, an image signal line (i.e., data bus) 3 and a pixel electrode 4. The scan line 2 connects to a gate 2*g* of the TFT 2, and the image signal line 3 connects to a source (or drain) of the TFT 2. A drain (or source) connects to the pixel electrode 4 made of a transparent conductive film. These elements are arranged in a matrix on an array side substrate 6 by forming and etching films.

The LCD panel also comprises a counter electrode 7 that is a transparent conductive film formed on a counter side substrate 8. A color LCD panel further comprises color filters disposed on the counter side substrate 8 corresponding to each pixel. Voltage applied to a liquid crystal layer of each pixel via the TFT is varied according to the image signal. Thus, transparency of liquid crystal at each pixel changes so that an image is displayed in the LCD panel as a whole.

FIG. 8 shows an equivalent circuit of an active matrix LCD panel. An image signal is applied to image signal lines A1, A2, . . . A*n*. A scan signal (i.e., gate signal) is applied to one of scan lines B1, B2, . . . B*m*. Each intersection of these lines (m×n points) is provided with a TFT Q11, Q12, . . . Q1*m*, Q21, Q22, . . . Q2*m*, . . . Q*n*1, Q*n*2, . . . or Q*n m*. A gate of each TFT is connected to the scan line B1, B2, . . . and B*m*. A source (or drain) of each TFT is connected to the image signal line. A drain (or source) of each TFT is connected to a pixel electrode that faces a counter electrode T holding a liquid crystal layer between the two electrodes.

A drive pulse, i.e., scan signal Φ1, Φ2, . . . Φ*m* is applied to a corresponding scan line B1, B2, . . . B*m*, respectively. Each scan signal turns on the TFTs connected to the scan line to which the scan signal is applied. Image signals are then supplied to the image signal lines A1, A2, . . . A*n* and are written into pixel electrodes via the TFTs that are turned on. The written state of each pixel is held until the next field when a new scan signal is applied. In this manner, every pixel is driven so that the entire LCD panel displays an image.

One method of driving such an LCD panel is written in Japanese Tokukaihei 2-157815. FIG. 9 shows waveforms of drive signals using this method (hereinafter called capacitively coupled driving method). A scan signal Φ*k* consists of four voltage levels, i.e., Vg for turning on the TFT, Voff for turning off the TFT, and compensation voltages Ve(+) and Ve(−). The compensation voltages Ve(+) and Ve(−) are applied alternately to scan lines (or lines for auxiliary capacitors). A relationship between an image signal voltage Vs and a liquid crystal voltage Vlc applied to a pixel is given by following two equations:

$$Vlc(+)=-Cgd\times Vg/Ct+Vs(+)+Cs/Ct\times Ve(-) \quad (1)$$

$$Vlc(-)=Cgd\times Vg/Ct-Vs(-)-Cs/Ct\times Ve(+) \quad (2)$$

where positive levels with respect to the counter electrode potential are represented by Vlc(+) and Vs(+), and negative levels with respect to the counter electrode potential are represented by Vlc(−) and Vs(−).

The liquid crystal voltage Vlc and the image signal voltage Vs alternate field by field. Cgd is a gate-drain capacitance of the TFT, Cs is an auxiliary capacitance provided to add capacitance to a liquid crystal capacitance Clc of each pixel, and Ct is a total capacitance of Cs, Clc and Cgd.

It is necessary to equalize voltages applied to the liquid crystal in every field. Therefore, supposing Vlc(+)=Vlc(−) and Vs(+)=Vs(−), the equation below is derived from the above two equations (1) and (2):

$$Ve(+)+Ve(-)=2\times Cgd\times Vg/Cs \quad (3)$$

This equation means that a good image display without a flicker or an image sticking effect can be obtained by adjusting a center level of two compensation voltages Ve(+) and Ve(−) to Cgd×Vg/Cs (Proceeding 9th International Display Research Conference, 580–583 pp).

A bias voltage Vbias of the image signal voltage Vs is given by the following equation:

$$Vbias=(Cs/Ct)\times(Ve(+)+Ve(-))/2 \quad (4)$$

Then, a signal level for an image signal IC can be minimized by setting a bias voltage Vbias in each field according to the following equation:

$$Vbias=(Cmax+Vth)/2 \quad (5)$$

where Vth is a threshold voltage of the liquid crystal, and Vmax is a maximum drive voltage of the liquid crystal. In general, Ve(+) and Ve(−) are determined to satisfy above equations (3) and (4). As an example, supposing that Vs=Vc=12.5 volt, Voff=0 volt, Ve(+) and Ve(−) are adjustable to minimize a flicker, Clc=0.3 pF, Cgd=0.03 pF, Vmax=5 volt, and Vth=1 volt, then Ve(−) is −8.3 volt and Ve(+) is 4.3 volt.

The conventional capacitively coupled driving method mentioned above is easy to equalize an average level of the counter voltage applied to the counter electrode and an average level of the image signal voltage. Therefore, this conventional driving method has the advantage of obtaining a high quality display with little image sticking effect by optimizing two compensation voltages Ve(−) and Ve(+).

However, this method also has one major disadvantage in that the scan signal consists of four voltages, each requiring its own voltage sources to be supplied to a driver IC of scan lines. An increase in chip size results in increased cost and power consumption.

SUMMARY OF THE INVENTION

This invention reduces power consumption and cost of LCD panels by decreasing the required number of power sources for the driver IC.

In the method of this invention, the scan signal consists of three voltage levels, i.e., an ON voltage Vg for turning on the TFT, an OFF voltage Voff for turning off the TFT, and a compensation voltage Ve having the opposite polarity with respect to the OFF voltage Voff. The compensation voltage Ve appears on alternate fields. In other words, the level of the scan signal changes from Vg to Voff via a period of Ve or directly field by field.

It is preferable to select the value of the compensation voltage Ve so as to fulfill the following equation (6):

$$Ve=2\times Cgd\times Vg/Cs \quad (6)$$

where Cgd is a gate-drain capacitance of the TFT, and Cs is an auxiliary capacitance provided to add capacitance to a liquid crystal capacitance of each pixel.

This invention also provides an LCD structure suited for the driving method mentioned above. In this LCD structure, the gate-drain capacitance of TFT is selected so as to fulfill the following equation (7):

$$Cgd=(Vth+Vmax)\times(Clc+Cs)/(2\times Vg-Vth-Vmax) \quad (7)$$

where Vth is the threshold level of the liquid crystal, Vmax is a maximum drive voltage of the liquid crystal and Clc is the liquid crystal capacitance per one pixel.

It is preferable that a driver circuit for providing the scan signal and the image signal be formed on the same substrate and in the same process as TFT forming. It is also preferable that the semiconductor material for the TFT be polysilicon.

DETAILED DESCRIPTION OF THE PREFERRED EMBODIMENTS

Figure 1:
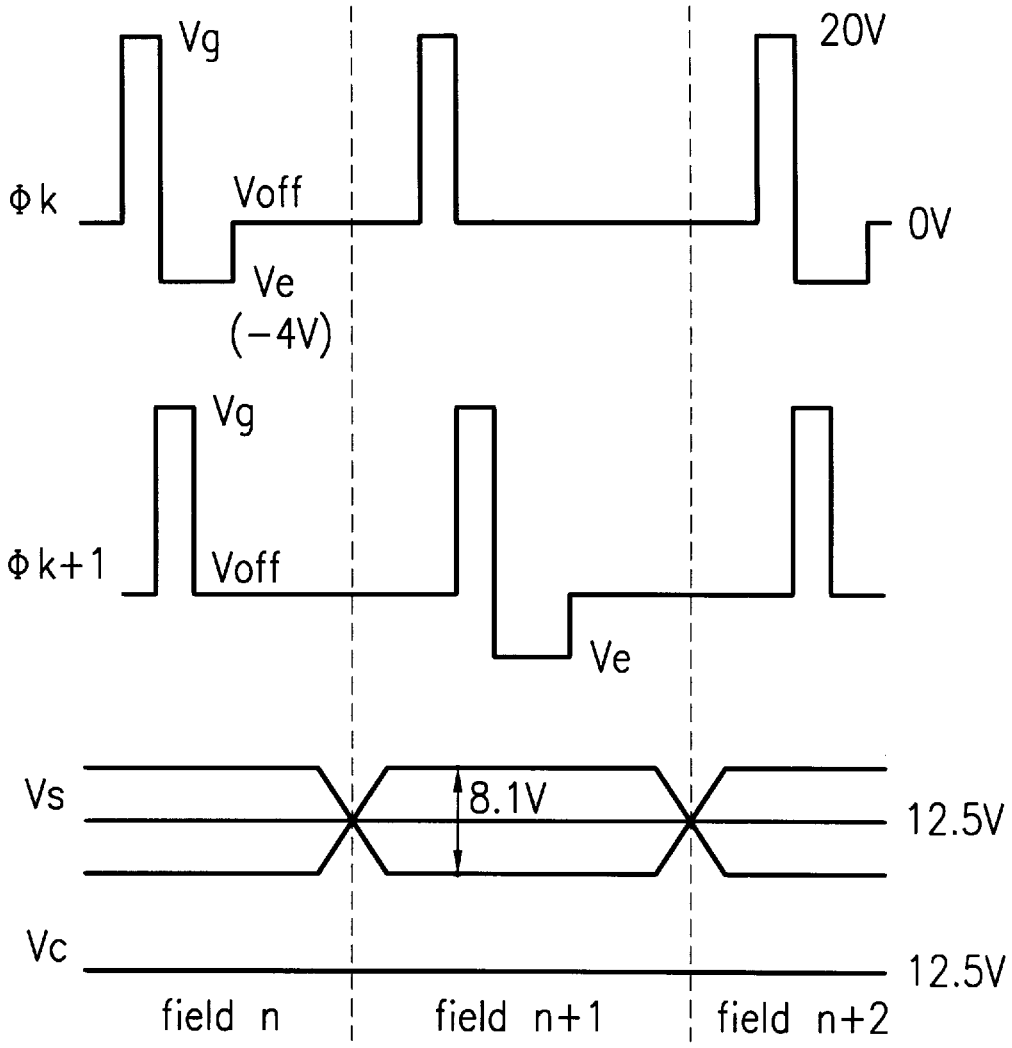
FIG. 1 illustrates waveforms in a first example of an LCD driving method according to an embodiment of this invention.

In a driving method of this invention, the scan signal consists of three voltage levels, i.e., an ON voltage Vg, an OFF voltage Voff, and a compensation voltage Ve. The driving method can be considered to eliminate either of two compensation voltages Ve(+) and Ve(−) of the conventional driving method by equalizing it to OFF voltage Voff so as to reduce the necessary voltage levels for the scan signal. It is known that the adequate values of the compensation voltages are 0 to 1 volt for Ve(+) and approximately −10 volt for Ve(−). Therefore, if Ve(+)=0 volt and Ve(−)=Ve in equation (3), then equation (6) is derived.

Moreover, the following equation (8) is derived from equations (3) and (4):

$$Vbias=Cgd\times Vg/Ct \quad (8)$$

where Ct=Cs+Clc+Cgd, as mentioned before. This equation (8) shows that the bias voltage Vbias does not depend on the compensation voltage Ve and that it is determined by the capacitances in the LCD panel design and the ON voltage Vg of the scan signal.

The reason that two variable compensation voltages Ve(+) and Ve(−) are used in the conventional driving method is to reduce flicker and sticking effect as well as to minimize the amplitude of the image signal as mentioned before. If reducing the flicker and sticking effect is the sole purpose, it is enough to apply the compensation voltage Ve that fulfills the equation (6). On the other hand, the value of the bias voltage Vbias is determined by equation (8) and the gate-drain capacitance Cgd in this equation can be controlled in the LCD panel design process. Therefore, the best value of Vbias is obtained by selecting design parameters so that the gate-drain capacitance Cgd fulfills equation (7).

In contrast with the conventional capacitively coupled driving method in which the brightness is adjusted while suppressing flicker and sticking effect by varying the bias voltage applied to the LCD panel, the driving method of this invention adopts the following ways to perform equivalent adjustment of the brightness. One technique is to adjust the amplitude of the counter voltage. Another technique is to vary the pedestal level that is superimposed evenly on the image signal.

Some samples in which this invention is embodied are now explained with reference to FIGS. 1 through 6. Voltage levels in the first example were as follows:

Vs=Vc=12.5 volt

Vg=20 volt

Voff=0 volt

Ve is adjustable (to be adjusted so as to minimize a flicker).

Design parameters of the LCD panel were as follows:

Clc=0.3 pF

Cgd=0.03 pF

Cs=0.3 pF

Twenty LCD panels with the above parameters were manufactured and the compensation voltage Ve of each panel was adjusted so that the flicker was minimized. The adjusted Ve of each pane was distributed between 3.5 and 4.5 volts. The result of this experiment substantially corresponds with the result (Ve=4 V) obtained when using equation (6) and the above parameters.

Figure 2:
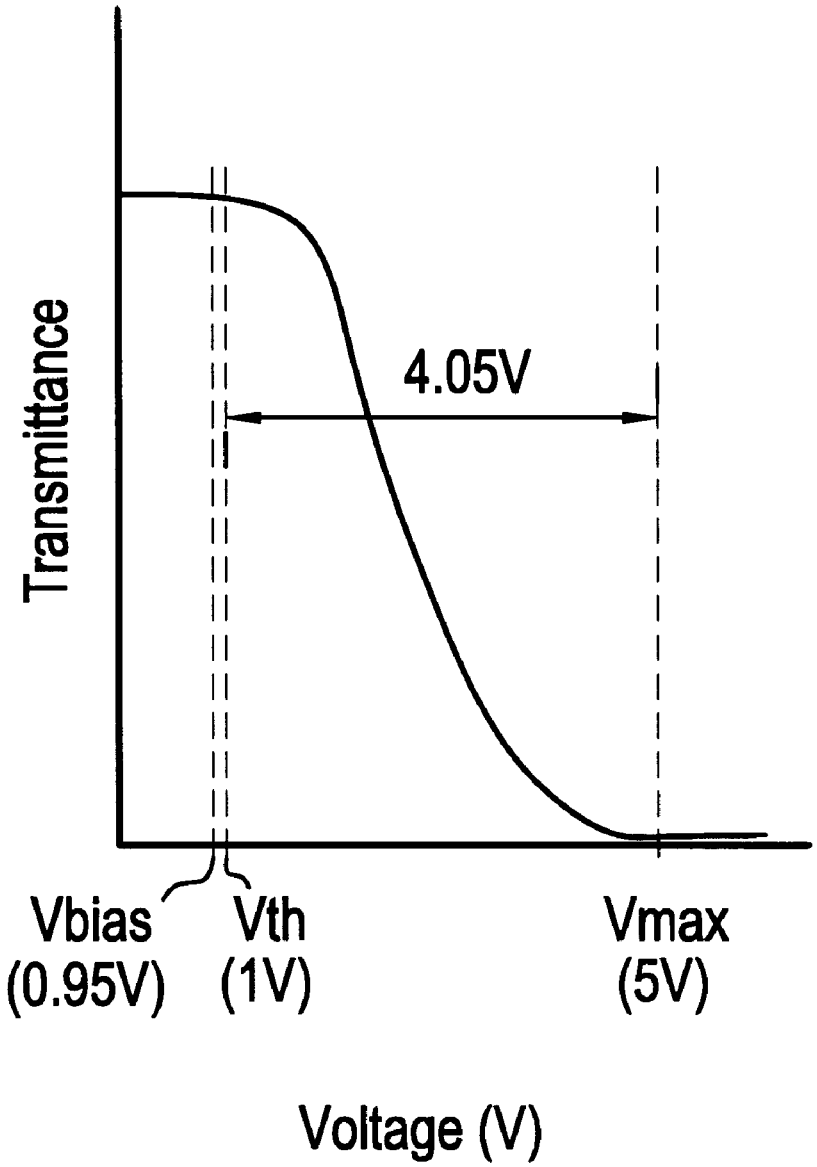
FIG. 2 is a graph showing transmittance-voltage characteristics of LCD in the driving method of FIG. 1.

FIG. 1 shows drive waveforms for the first example of an LCD panel of this invention. A gate-drain capacitance Cgd was not optimized in the design process. The bias voltage Vbias obtained from equation (8) is 0.95 volts. In this case, supposing that the threshold voltage Vth of the liquid crystal is 1 volt, and a maximum drive voltage Vmax is 5 volts, then the necessary signal amplitude Vsigpp is 8.1 volts ((5−0.95)×2 V) as illustrated in FIG. 2. This figure shows a of transmittance-voltage characteristic.

Thus, the chip size of the driver IC was reduced by 30% as compared to a conventional driver IC performing a conventional capacitively coupled driving method. Moreover, this invention can be applied to an LCD panel with integrated drivers so that designs of peripheral circuits can be simplified and the space occupied by peripheral parts of the LCD screen can be reduced.

Voltage levels in the second example were as follows:

Vs=Vc=12.5 volt

Vg=20 volt

Voff=0 volt

Ve is adjustable (to be adjusted to minimize flicker).

Design parameters of the LCD panel were as follows:

Clc=0.3 pF

Cgd=0.09 pF

Cs=0.3 pF

Figure 3:
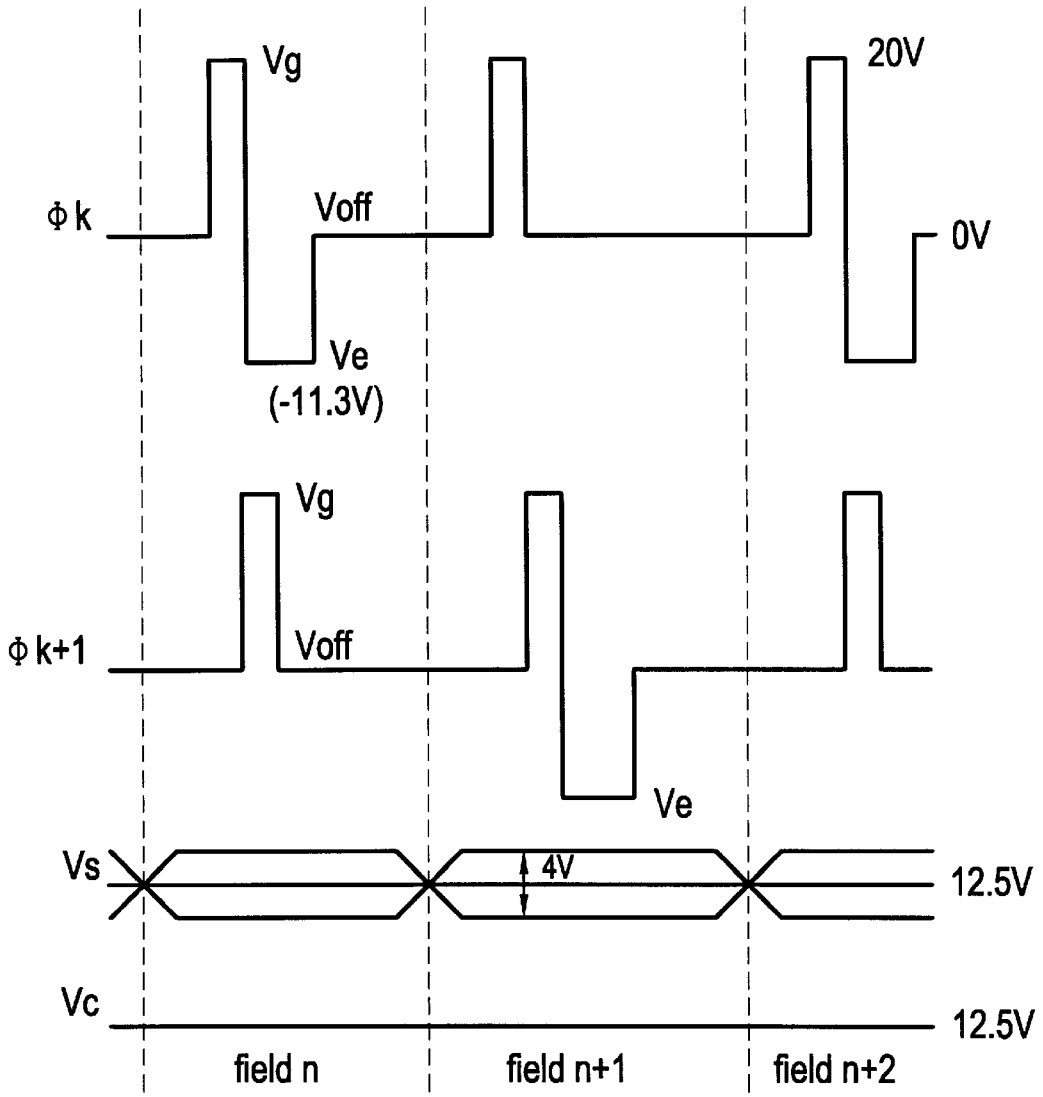
FIG. 3 illustrates waveforms in a second example of an LCD driving method according to an embodiment of this invention.

In contrast with the first example, the value of the gate-drain capacitance Cgd was optimized so as to fulfill equation (7) in the design process. FIG. 3 shows the drive waveforms for the LCD panel of the second example of this invention. The transmittance-voltage characteristic of the liquid crystal is the same as the first example's shown in FIG. 2.

Twenty LCD panels with the above parameters were made and the compensation voltage Ve of each pane was adjusted so that the flicker was minimized. The adjusted Ve of each panel was distributed between 11 and 12 volts. This experiment result substantially corresponds with the result (Ve=11.3 volt) obtained from the equation (6) and above parameters.

Figure 4:
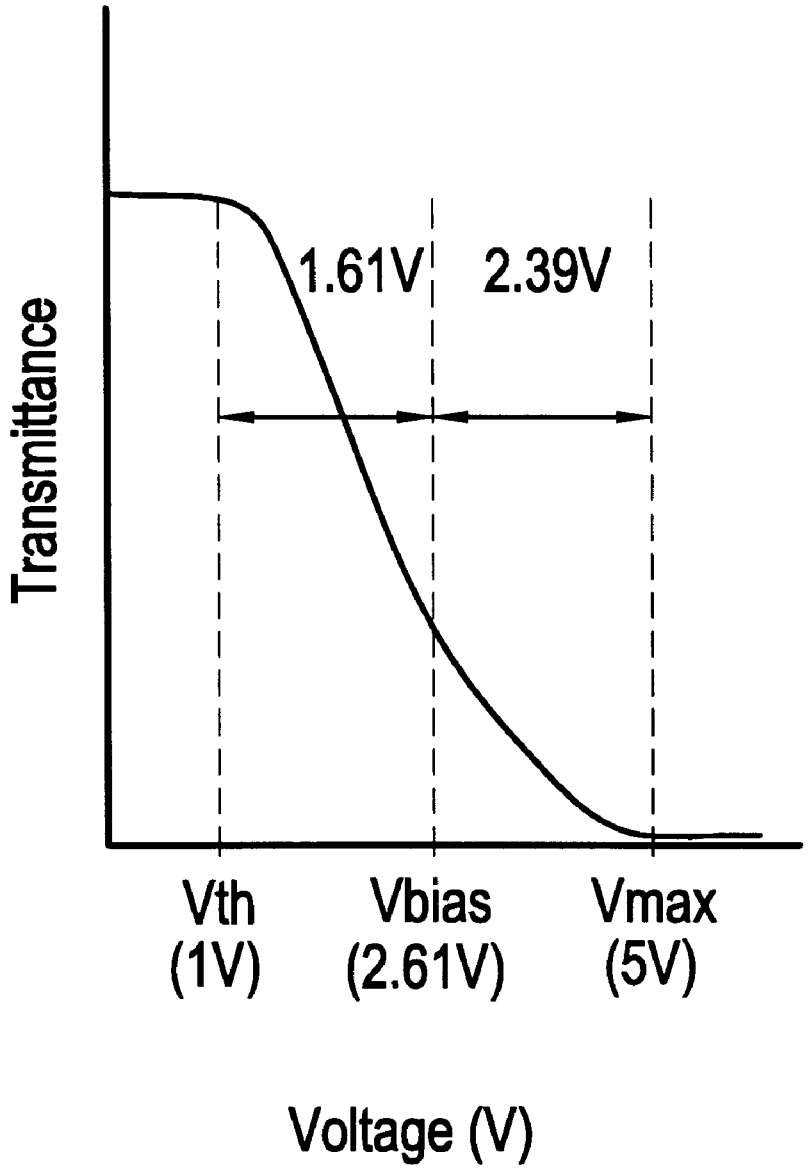
FIG. 4 is a graph showing transmittance-voltage characteristics of LCD in the driving method of FIG. 3.

The bias voltage Vbias obtained from the equation (8) is 2.6 volts. In this case, supposing a threshold voltage Vth of the liquid crystal is 1 volt, and a maximum drive voltage Vmax is 5 volt, a necessary signal amplitude Vsigpp is 4.78 volt ((5−2.61)×2 volt). Thus the value of Vsigpp was substantially reduced compared with that in the first example. If the value of Vbias is adjusted to 3 volt that is a center value of Vth and Vmax as shown in FIG. 4 by optimizing design parameters, the value of Vsigpp may be reduced to 4 volt ((5−3)×2 volt).

Figure 5:
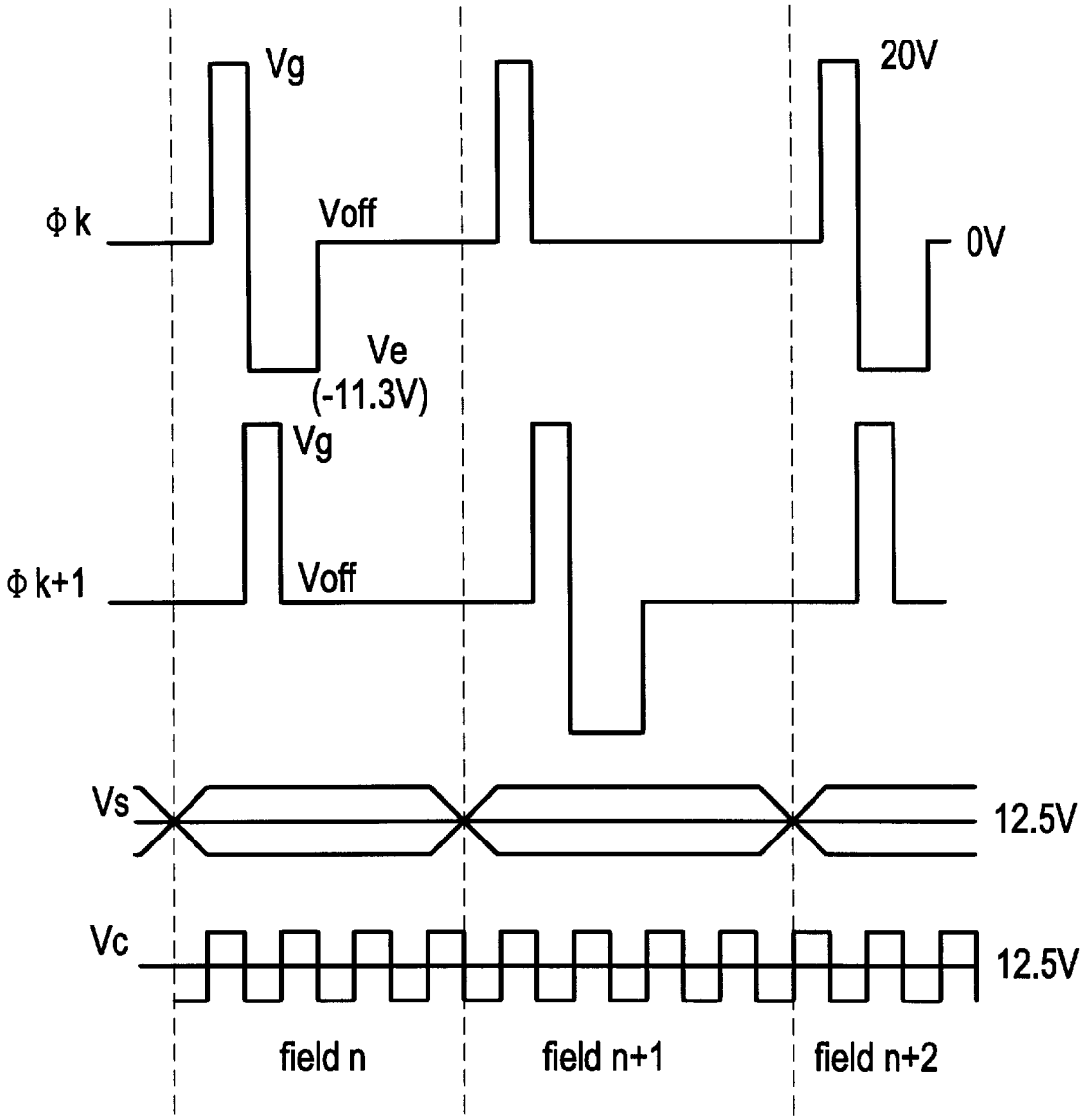
FIG. 5 illustrates waveforms in an example for adjusting LCD brightness by applying an alternating rectangular wave voltage to the counter electrode and varying the amplitude of the rectangular wave voltage in a driving method in accordance with an embodiment of this invention.
Figure 6:
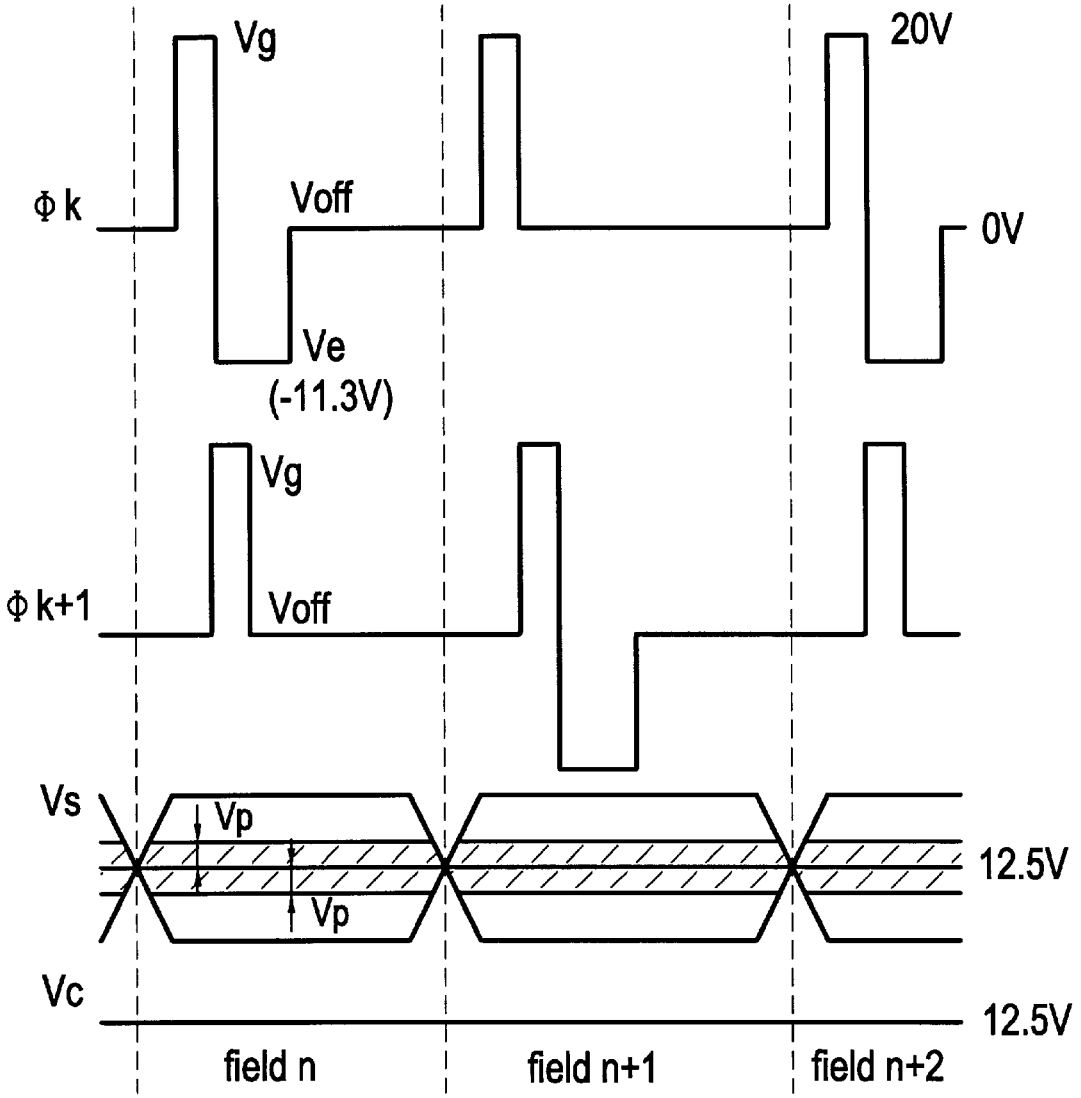
FIG. 6 illustrates waveforms in another example for adjusting LCD brightness by superimposing a pedestal voltage Vp on the image signal and varying the amplitude of the pedestal voltage in the driving method according to an embodiment of this invention.
Figure 7:
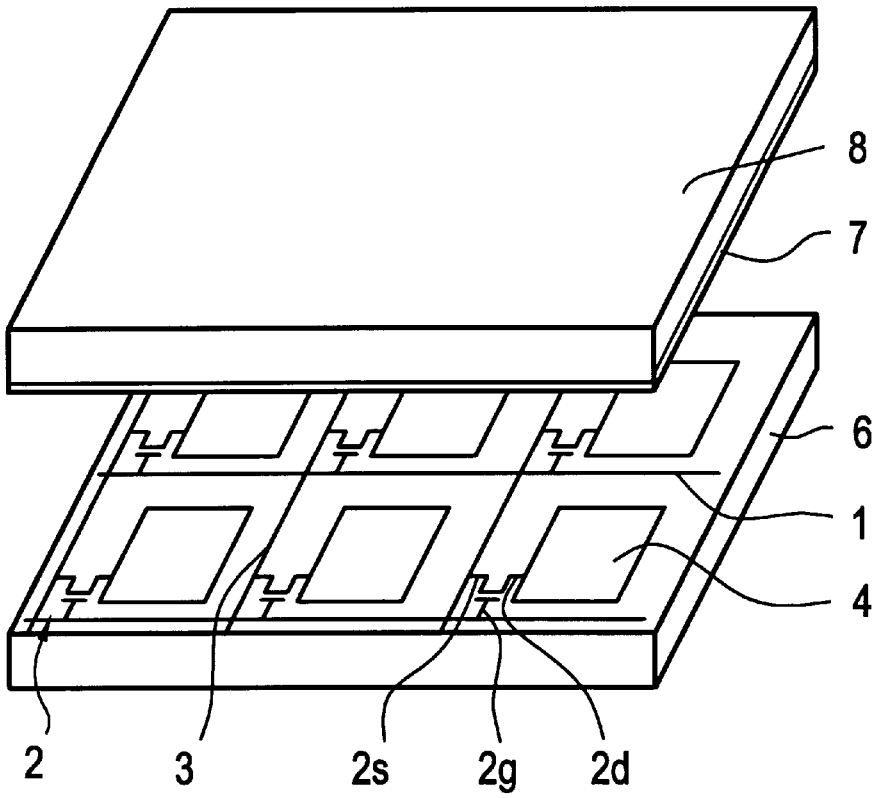
FIG. 7 illustrates a general structure for an active matrix LCD.
Figure 8:
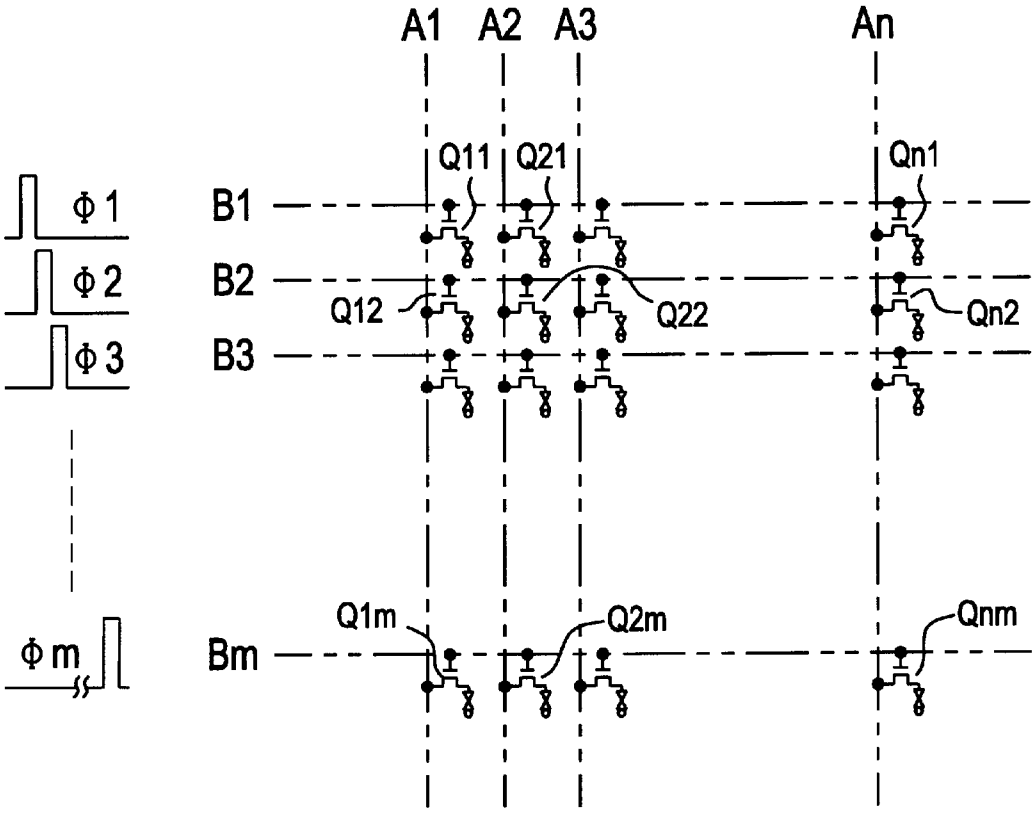
FIG. 8 illustrates an equivalent circuit for an active matrix LCD.
Figure 9:
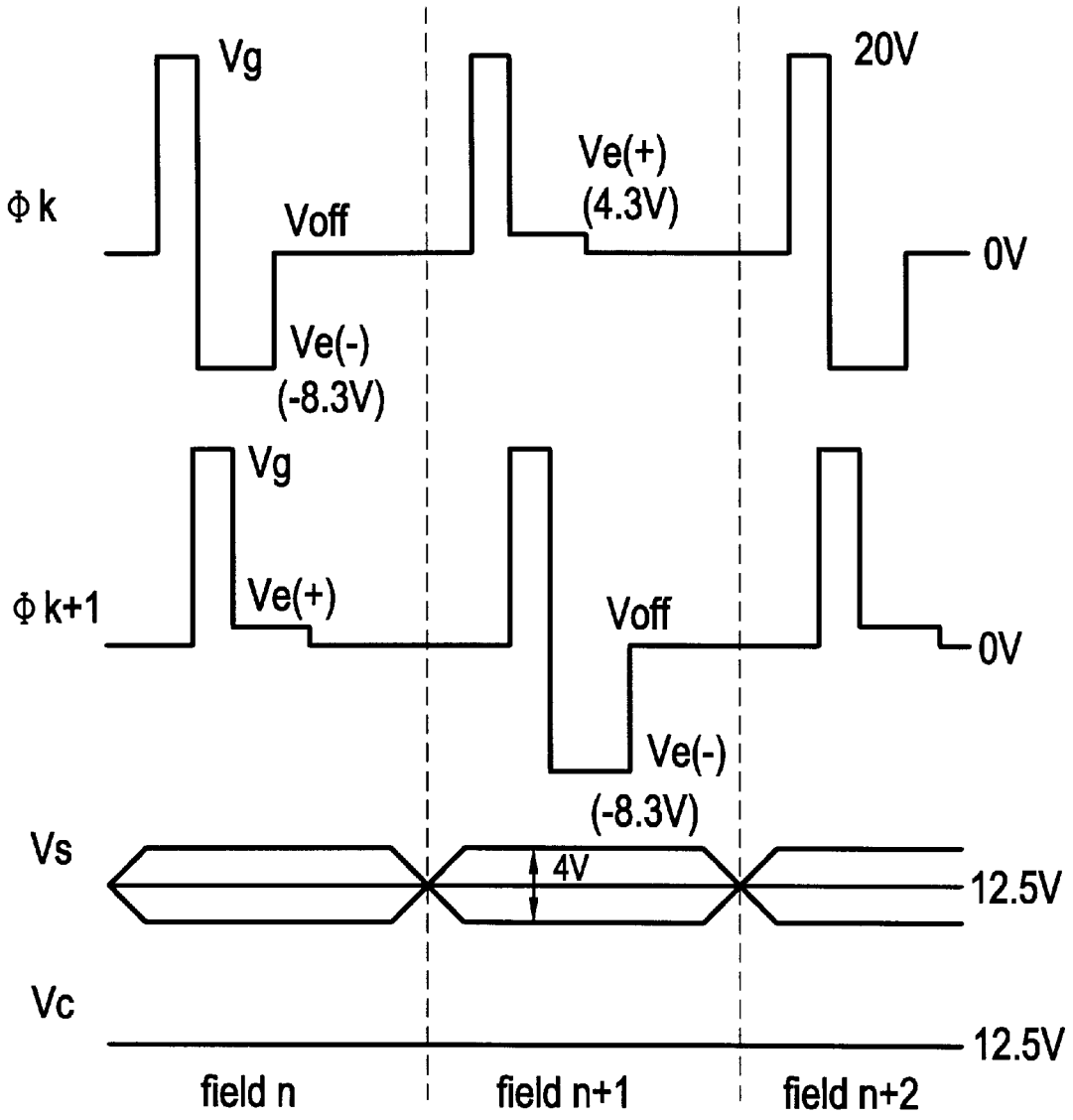
FIG. 9 illustrates waveforms in a conventional capacitively coupled driving method.
Figure 10:
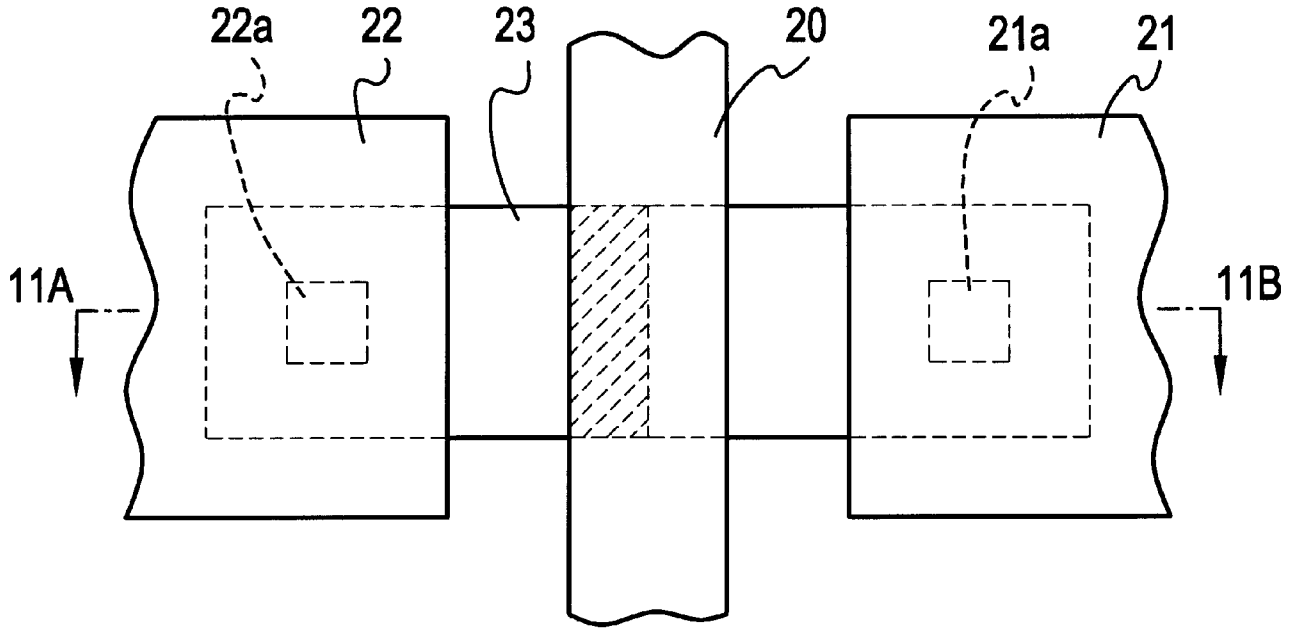
FIG. 10 is a plan view showing a structure of a TFT.
Figure 11:
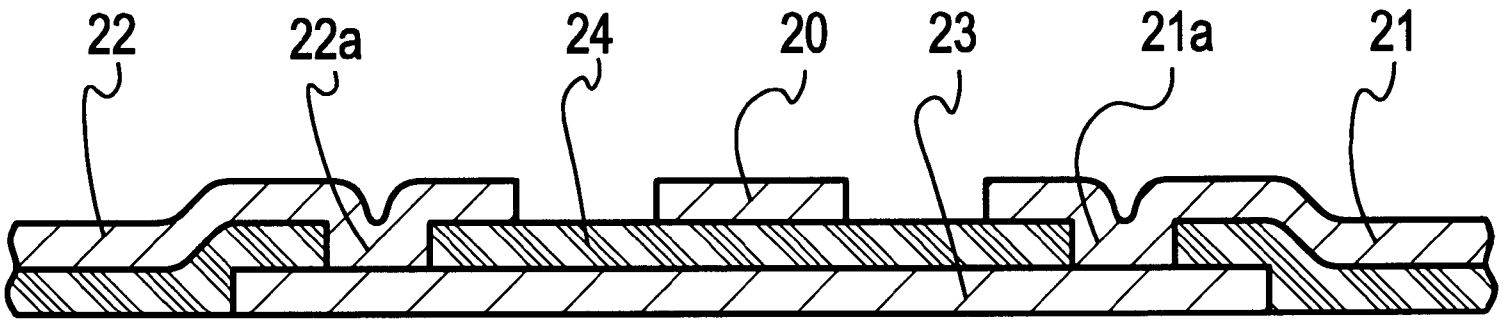
FIG. 11 is a section view along the 11A–11B line of FIG. 10.

FIG. 5 shows a method for adjusting the brightness of the LCD panel by applying not a DC voltage but an alternating rectangular wave voltage Vc to the counter electrode, and varying the amplitude of this counter voltage Vc. Alternatively, as shown in FIG. 6, a predetermined level of pedestal voltage Vp may be superimposed on the image signal Vs, and the amplitude of the pedestal voltage Vp may be varied. Either of these methods for adjusting the brightness of the LCD panel can be used together with the driving method of this invention. Thus, the driving method of this invention, in which the scan signal consists of three voltage levels, can provide image quality and reliability equivalent to the conventional capacitively coupled driving method whose scan signal consists of four voltage levels.

As mentioned above, this invention provides a novel method for driving LCD using the scan signal consisting of three voltage levels without degradation due to flickers or other causes. Consequently, cost and power consumption for a driver IC can be reduced. Moreover, by applying this invention to an LCD panel with integrated driver circuits, the design is simplified and a peripheral space of the LCD panel can be reduced.

What is claimed is:

1. A method for driving an active matrix LCD that comprises plural pairs of pixel electrodes and corresponding thin film transistors disposed in a matrix on a substrate, a plurality of image signal lines for applying an image signal to the pixel electrodes via the corresponding thin film transistors, a plurality of scan lines in communication with gates of the thin film transistors and a transparent counter-electrode facing the pixel electrodes holding a crystal layer therebetween, the method comprising:

providing a scan signal via the scan lines comprising an OFF voltage Voff for turning off the thin film transistors and an ON voltage Vg for turning on the thin film transistors; and superimposing a compensation voltage Ve having an opposite polarity with respect to the OFF voltage Voff on alternate scan signals of each field such that every other scan line is compensated in an alternative way with a corresponding scan line of a next field, wherein the method uses only three voltage levels for driving the active matrix LCD.

2. The method of claim 1, wherein the value of the compensation voltage Ve is selected so as to fulfill the following equation:

$$Ve=2\times Cgd\times Vg/Cs$$

where Cgd is a gate-drain capacitance of the thin film transistor, Cs is an auxiliary capacitance, and Vg is the ON voltage for turning on the thin film transistors.

3. An active matrix liquid crystal display suited for the method of claim 1, wherein the gate-drain capacitance of TFT is selected so as to fulfill the following equation:

$$Cgd=(Vth+Vmax)\times(Clc+Cs)/(2\times Vg-Vth-Vmax)$$

where Vth is a threshold level of the liquid crystal, Vmax is a maximum drive voltage of the liquid crystal, Cs is an auxiliary capacitance, and Clc is a liquid crystal capacitance per one pixel.

4. The active matrix liquid crystal display of claim 3, wherein a driver circuit for providing the scan signal to the scan lines and the image signal to the image signal lines is formed on the same substrate in the same process as thin film transistor forming.

5. The active matrix liquid crystal display of claim 3, wherein the semiconductor material for the thin film transistor is polysilicon.

* * * * *